US006120259A

United States Patent [19]

Miyaji et al.

[11] Patent Number: 6,120,259

[45] Date of Patent: Sep. 19, 2000

[54] SWASH PLATE TYPE COMPRESSOR

[75] Inventors: Toshikatsu Miyaji; Masaki Kawachi, both of Tochigi, Japan

[73] Assignee: Calsonic Corporation, Tokyo, Japan

[21] Appl. No.: 09/175,540

[22] Filed: Oct. 20, 1998

[30] Foreign Application Priority Data

Oct. 21, 1997 [JP] Japan ..... 9-288783

[51] Int. Cl.[7] ..... F01B 3/02; F04B 1/12; F04B 27/08

[52] U.S. Cl. ..... 417/269; 417/222.1

[58] Field of Search ..... 417/222.1, 222.2, 417/269; 92/71, 12.2, 165 R, 165 PR; 91/499

[56] References Cited

U.S. PATENT DOCUMENTS

| | | | |
|---|---|---|---|
| 4,416,190 | 11/1983 | Ishizuka | 92/71 |
| 4,544,332 | 10/1985 | Shibuya | 417/269 |
| 5,044,892 | 9/1991 | Pettitt | 417/269 |
| 5,370,505 | 12/1994 | Takenaka et al. | 417/269 |
| 5,407,328 | 4/1995 | Kimura et al. | 417/269 |
| 5,706,716 | 1/1998 | Umemura | 417/269 |
| 5,749,712 | 5/1998 | Umemura | 417/269 |

FOREIGN PATENT DOCUMENTS

| | | |
|---|---|---|
| 0 523 665 | 1/1993 | European Pat. Off. . |
| 5-195949 | 8/1993 | Japan . |
| 6-101640 | 4/1994 | Japan . |
| 7-103138 | 4/1995 | Japan . |
| 8-61231 | 3/1996 | Japan . |

*Primary Examiner*—Willis R. Wolfe
*Attorney, Agent, or Firm*—Foley & Lardner

[57] ABSTRACT

A swash plate type compressor comprises a case including a cylindrical cylinder block; a drive shaft installed in the case and rotatable about its axis; a swash plate carried by the drive shaft s and rotatable together therewith; a cylindrical rear housing having refrigerant intake and exhaust chambers defined therein; and a sealing structure arranged between the cylinder block and the rear housing to assure a hermetical sealing therebetween. The sealing structure comprises a rear annular flat end possessed by the cylinder block; a front annular flat end possessed by the rear housing and attached to the rear annular flat end; an annular groove formed in one of the rear and front annular flat ends, the annular groove consisting of mutually merged first and second annular recesses, the first annular recess being positioned radially inside of the second annular recess and having a deeper bottom than the second annular recess; a valve plate interposed between the cylinder block and the rear housing having a peripheral portion thereof received and compressed in the first annular recess; and a seal ring received and compressed in the second annular recess.

6 Claims, 2 Drawing Sheets

SWASH PLATE TYPE COMPRESSOR

BACKGROUND OF THE INVENTION

1. Field of the Invention

The present invention relates in general to compressors for use in a refrigerating cycle of an automotive air conditioning system, and more particularly to compressors of a swash plate type.

2. Description of the Prior Art

Japanese Patent First Provisional Publication 7-103138 shows a conventional swash plate type compressor which comprises a case with a cylindrical cylinder block, a drive shaft rotatably installed in the case, a swash plate rotated together with the drive shaft, a plurality of cylinders defined by the cylinder block, and a plurality of pistons respectively accommodated in the cylinders and reciprocatively driven by the swash plate. To a back side of the cylinder block, there is attached through a valve plate a cylindrical rear housing which has refrigerant intake and exhaust chambers formed therein.

For achieving a hermetical sealing between an annular flat end of the cylinder block and that of the rear housing, there is compressed therebetween a seal ring. The seal ring is received and compressed in an annular groove formed in the annular flat end of the cylinder block. The annular groove disclosed by the above-mentioned publication is an annular groove defined between inside and outside annular walls.

However, due to provision of such annular groove, the annular end of the cylinder block and thus that of the rear housing have unavoidably an increased thickness as measured in a radial direction, which causes a bulky and heavy construction of the compressor.

SUMMARY OF THE INVENTION

It is therefore an object of the present invention to provide a compact and light-weight swash plate type compressor.

According to the present invention, there is provided a swash plate type compressor which assures a hermetical sealing between a cylinder block and a rear housing without increasing the thickness of the mutually attached annular flat ends of the cylinder block and the rear housing.

According to the present invention, there is provided a swash plate type compressor which comprises a case including a cylindrical cylinder block; a drive shaft installed in the case and rotatable about its axis; a swash plate carried by the drive shaft and rotatable together therewith; a cylindrical rear housing having refrigerant intake and exhaust chambers defined therein; and a sealing structure arranged between the cylinder block and the rear housing to assure a hermetical sealing therebetween, wherein the sealing structure comprises a rear annular flat end possessed by the cylinder block; a front annular flat end possessed by the rear housing and attached to the rear annular flat end; an annular groove formed in one of the rear and front annular flat ends, the annular groove consisting of mutually merged first and second annular recesses, the first annular recess being positioned radially inside of the second annular recess and having a deeper bottom than the second annular recess; a valve plate interposed between the cylinder block and the rear housing having a peripheral portion thereof received and compressed in the first annular recess; and a seal ring received and compressed in the second annular recess.

BRIEF DESCRIPTION OF THE DRAWINGS

Other objects and advantages of the present invention will become apparent from the following description when taken in conjunction with the accompanying drawings, in which.

DETAILED DESCRIPTION OF THE INVENTION

Figure 1:
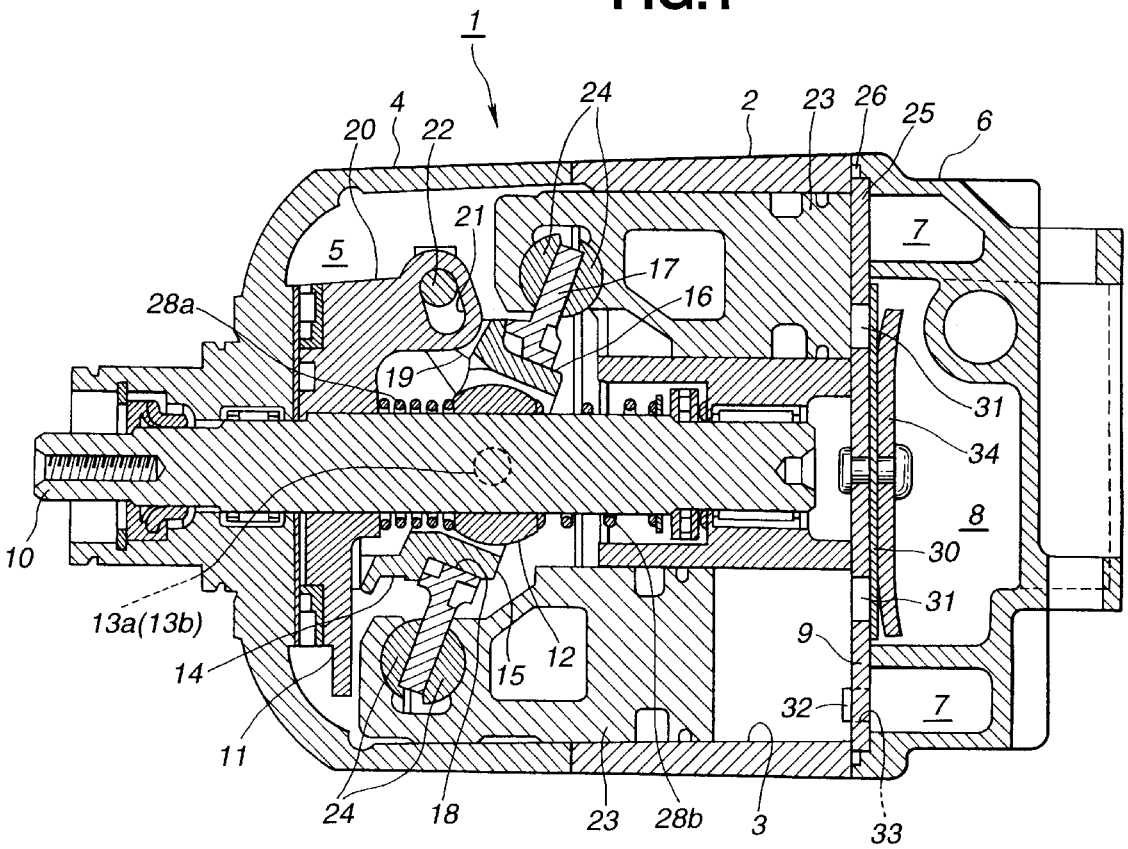
FIG. 1 is a sectional view of a variable displacement swash plate type compressor to the present invention is practically applied.

Referring to the drawings, particularly FIG. 1, there is shown a variable displacement swash plate type compressor 1 to which the present invention is practically applied.

As is shown in FIG. 1, the compressor 1 comprises a cylindrical cylinder block 2 having a plurality of cylinders 3 circularly arranged therein, a cylindrical front housing 4 coaxially connected to a front end of the cylinder block 2 to define therein a crank chamber 5, and a cylindrical rear housing 6 connected to a rear end of the cylinder block 2 to define therein refrigerant intake and exhaust chambers 7 and 8.

As will be described in detail hereinafter, a valve plate 9 is interposed between the cylinder block 2 and the rear housing 6.

In the crank chamber 5, there extends axially a drive shaft 10 to which a drive plate 11 is fixed to rotate therewith. Behind the drive plate 11, there is positioned a sleeve 12 which is axially movably disposed on the drive shaft 11. First and second biasing springs 28*a* and 28*b* are disposed on the drive shaft 11, between which the sleeve 12 is interposed and balanced. A journal 14 is pivotally connected to the sleeve 12 through aligned pins 13*a* and 13*b*. A circular swash plate 17 is concentrically mounted on the journal 14 to move therewith. For this mounting, the swash plate 17 has its threaded cylindrical inner wall 18 engaged with a threaded cylindrical outer wall 16 of a boss portion 15 of the journal 14. That is, a so-called screw-nut connection is provided between the swash plate 17 and the journal 14.

The journal 14 is formed with a forwardly projected arm 19 which is pivotally connected with a rearwardly projected arm 20 of the drive plate 11. For this pivotal connection, the arm 20 is formed with an elongate opening 21 with which a pin 22 possessed by the arm 19 is slidably engaged. Due to this pivotal connection, the pivotal movement of the swash plate 17 relative to the drive shaft 10 is suitably restricted.

The cylinders 3 in the cylinder block 2 have respective pistons 23 slidably received therein. Each piston 23 has an exposed neck portion which slidably holds a peripheral portion of the swash plate 17 through a pair of shoes 24. That is, the shoes 24 are pivotally held by the neck portion while slidably putting therebetween the peripheral portion of the swash plate 17.

The inclination angle of the swash plate 17 is determined by a pressure in the crank chamber 5, which is controlled by a pressure control valve (not shown) in accordance with a pressure in the refrigerant intake chamber 7. The detail of the pressure control valve is shown in, for example, U.S. Pat. No. 5,749,712 granted to Yukio UMEMURA on May 12, 1998. In accordance with the inclination angle of the swash plate 17, the stroke of each piston 23 is changed thereby varying the displacement of the compressor 1.

Denoted by numerals 30 are reed valves for opening and closing outlet openings 31 formed in the valve plate 9, denoted by numerals 32 are reed valves for opening and closing inlet openings 33 formed in the valve plate 9, and denoted by numeral 34 is a retainer for retaining open degree of the reed valves 30.

When, in operation, the drive shaft 10 is rotated by, for example, an engine of an associated motor vehicle, the drive plate 11 and the inclined swash plate 17 are rotated together about an axis of the drive shaft 10. Due to the rotation of the inclined swash plate 17, the pistons 23 are forced to reciprocate in the associated cylinders 3 thereby to compress a refrigerant directed to the exhaust chamber 8. When the inclination angle of the swash plate 17 is changed due to the above-mentioned reason, the stroke of the pistons 23 is changed and thus the displacement of the compressor 1 is varied.

The compressor of the present invention has the following features which will be described with reference to FIGS. 1, 2 and 3.

Figure 2:
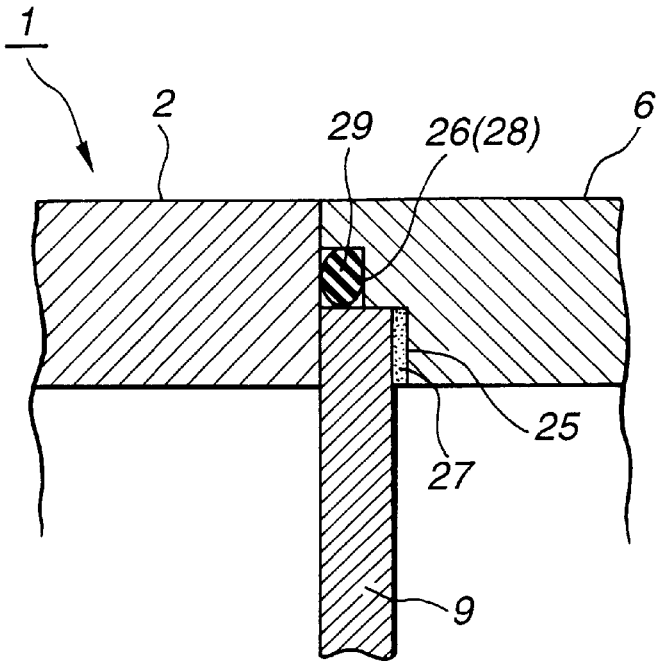
FIG. 2 is an enlarged sectional view of an essential portion of the present invention, where a cylinder block and a rear housing are attached to each other at their annular flat ends.

As is best seen from FIG. 2, a rear annular flat end of the rear housing 6 is formed at a radially inside portion thereof with an annular groove 28 which consists of mutually merged first and second annular recesses 25 and 26 which are concentric with each other. As shown, the first annular recess 25 is positioned radially inside of the second annular recess 26, and has a deeper bottom than the second annular recess 26. Of course, the annular groove 28 may be formed in a rear annular flat end of the cylinder block 2.

As shown in FIG. 2, an annular gasket 27 and a peripheral portion of the valve plate 9 are put in the first annular recess 25 and a seal ring 29 is put in the second annular recess 26. As shown, when the rear housing 6 is properly mounted to the rear annular flat end of the cylinder block 2, the annular gasket 27 and the peripheral portion of the valve plate 9 as well as the seal ring 29 are compressed by a certain degree in the recesses 25 and 26. With this, a hermetical sealing between the rear housing 6 and the cylinder block 2 is achieved. As is seen from FIG. 3, when the annular gasket 27 and the peripheral portion of the valve plate 9 have no stress applied thereto, a front surface of the valve plate 9 projects by a certain degree "S" from the front annular flat end of the rear housing 6. Thus, upon assembly, the annular gasket 27 and the peripheral portion of the valve plate 9 are compressed by the degree "S".

In the following advantages possessed by the compressor 1 of the present invention will be described.

First, upon assembly, as is seen from FIG. 2, the periphery of the valve plate 9 assuredly holds an inner side of the compressed seal ring 29. That is, the periphery of the valve plate 9 serves as an inside annular wall of the recess 26 which is present in the above-mentioned conventional compressor. In other words, in the present invention, the thickness of the mutually attached annular flat ends of the cylinder block 2 and the rear housing 6 can be reduced by a degree corresponding to the thickness of the inside annular wall. Thus, the compressor 1 of the invention can be constructed compact in size and light in weight.

Figure 3:
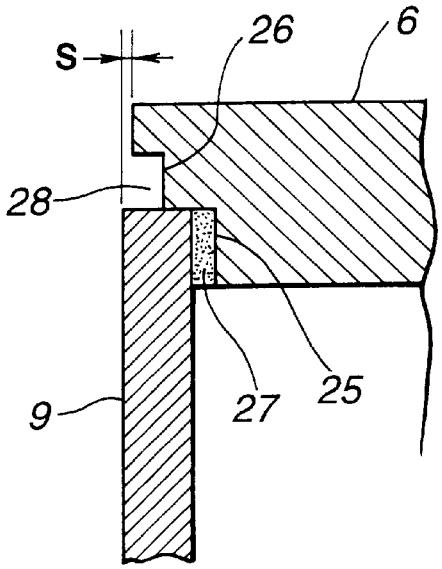
FIG. 3 is a view similar to FIG. 2, with some parts removed for clarification of the essential portion.

Second, as is seen from FIG. 3, before coupling the cylinder block 2 and the rear housing 6, the valve plate 9 projects somewhat, that is, by the degree "S" from the front annular flat end of the rear housing 6. Under this condition, the seal ring 29 can be easily put into the annular recess 26 using the projected periphery of the valve plate 9 as a guide means.

It is to be understood that although the above description is directed to the compressor of a variable displacement type, the concept of the present invention can be applied to swash plate type compressors which are not of the variable displacement type.

It is further to be understood that, although the invention has been described with specific reference to a particular embodiment thereof, it is not to be so limited since changes and alternations therein may be made within the full intended scope of this invention as defined by the appended claims.

What is claimed is:

1. A swash plate type compressor comprising:

a case including a cylindrical cylinder block;

a drive shaft installed in said case and rotatable about its axis;

a swash plate carried by said drive shaft and rotatable together therewith;

a cylindrical rear housing having refrigerant intake and exhaust chambers defined therein; and a sealing structure arranged between said cylinder block and said rear housing to assure a hermetical sealing therebetween, wherein said sealing structure comprises:

a rear annular flat end possessed by said cylinder block;

a front annular flat end possessed by said rear housing and attached to said rear annular flat end;

an annular groove formed in one of said rear and front annular flat ends, said annular groove consisting of mutually merged first and second annular recesses, said first annular recess being positioned radially inside of said second annular recess and having a deeper bottom than said second annular recess;

a valve plate interposed between said cylinder block and said rear housing having a peripheral portion thereof received and compressed in said first annular recess; and a seal ring received and compressed in said second annular recess, in which said sealing structure further comprises an annular gasket which is received in the bottom of said first annular recess to support the peripheral portion of said valve plate.

2. A swash plate type compressor as claimed in claim 1, in which the depth of said first annular recess is so determined as to cause a font surface of said valve plate to project from said front annular flat end when said peripheral portion of the valve plate and said annular gasket have no stress applied thereto.

3. A swash plate type compressor as claimed in claim 1, in which the periphery of said valve plate has such a size as to hold an inner side of said seal ring compressed in said second annular recess.

4. A swash plate type compressor as claimed in claim 1, further comprising:

a plurality of cylinders circularly arranged in said cylinder block; and a plurality of pistons driven by said swash plate to be reciprocatively moved in said cylinders.

5. A swash plate type compressor as claimed in claim 1, in which said valve plate is formed with inlet openings through which a refrigerant in said refrigerant intake chamber of said rear housing is led into said cylinders to be compressed, and outlet openings through which the compressed refrigerant in said cylinders is led to said refrigerant discharge chamber of said rear housing.

6. A swash plate type compressor as claimed in claim 5, in which each of said inlet and outlet openings is provided with a reed valve to control a flow of the refrigerant.

* * * * *